United States Patent [19]

Greenlee et al.

[11] Patent Number: 4,856,583

[45] Date of Patent: Aug. 15, 1989

[54] APPARATUS FOR TREATING WELL BORES

[75] Inventors: Donald R. Greenlee, Cedar Hill; Willie C. Skinner, Sr., Midland, both of Tex.

[73] Assignee: Dresser Industries, Inc., Dallas, Tex.

[21] Appl. No.: 123,332

[22] Filed: Nov. 20, 1987

[51] Int. Cl.[4] ..... E21B 33/124; E21B 43/12

[52] U.S. Cl. ..... 166/127; 166/128; 166/131; 166/184; 166/191

[58] Field of Search ..... 166/127, 128, 131, 138, 166/139, 140, 191, 186, 240, 184

[56] References Cited

U.S. PATENT DOCUMENTS

| | | | |
|---|---|---|---|
| 2,715,444 | 8/1955 | Fewel | 166/191 X |
| 3,169,579 | 2/1965 | Haines | 166/131 X |
| 4,569,396 | 2/1986 | Brisco | 166/191 X |
| 4,590,995 | 5/1986 | Evans | 166/128 X |
| 4,605,062 | 8/1986 | Klumpyan et al. | 166/128 X |
| 4,640,351 | 2/1987 | Clifton et al. | 166/127 |
| 4,671,352 | 6/1987 | Magee, Jr. et al. | 166/127 X |
| 4,722,400 | 2/1988 | Burns | 166/131 X |

*Primary Examiner*—Hoang C. Dang

*Attorney, Agent, or Firm*—Edward G. Fiorito; William R. Peoples; Roy L. Van Winkle

[57] ABSTRACT

Treating apparatus arranged to be positioned in well bores that includes a packer that is retrievable and resettable and that provides a spaced pair of sealing elements to isolate a zone in the well bore. A valve operable within the packer is moveable among positions wherein fluid can be circulated through the operations, an open position wherein the treating fluids can be injected into the zone to be treated, and a closed position wherein the selected zone can be sealed off.

5 Claims, 5 Drawing Sheets

APPARATUS FOR TREATING WELL BORES

BACKGROUND OF THE INVENTION

This invention relates generally to apparatus useful in treating well bores and the like. More particularly, and not by way of limitation, this invention relates to treating apparatus including a packer having spaced packing members and a valve for controlling the flow of fluid through the packer and into the zone isolated by the packing members for treating the well formations.

In the treating of oil and gas wells and the like, it is often necessary or desirable to isolate a zone in the well and inject acidizing materials, fracturing fluids, or the like into the isolated zone. It is also highly desirable to treat multiple zones in the well by moving the apparatus from one zone to another. Simultaneously with the above, it is frequently desirable to be able to circulate the fluids into and out of the well bore, to place the treating fluid between the straddle packers when desired, to be able to close off the isolated zone thus sealing the treating fluids in the isolated zone, and to be able to pump fluids through the apparatus as desired.

Apparatus for performing all of the foregoing processes have been constructed in the past, but such apparatus has been very complex and required many different pieces of equipment to perform the various operations. No one piece of equipment constructed herein before has been capable of providing all of the foregoing advantages.

The object of this invention is to provide a relativley simple, single piece of apparatus that is capable of performing all of the aforesaid operations.

SUMMARY OF THE INVENTION

This invention provides apparatus for treating well bores that is arranged to be positioned in the well bore on tubing. The apparatus comprises a packer having first and second spaced deformable packing elements thereon for isolating a portion of the well bore, gripping slips for locking the packer in the well bore and a plurality of ports extending through a packer mandrel between the packing elements which provides communication between the interior of the packer and the isolated portion of the well bore. The apparatus also includes a hollow elongated valve that is disposed within the packer and that is moveable with respect to the packer among, open, closed and circulate positions for permitting fluid flow through the ports to the isolated portion, preventing fluid flow through the ports to the isolated portion and for circulating fluid through the apparatus. The apparatus also includes means for operating the packer during setting, releasing, moving the valve means, and for deforming and releasing the packer elements.

BRIEF DESCRIPTION OF THE DRAWING

The foregoing and additional objects and advantages of the invention will become more apparent as the following detailed description is read in conjunction with the accompanying drawing wherein like reference characters denote like parts and all views and wherein.

DETAILED DESCRIPTION OF THE PREFERRED EMBODIMENT

Figure 1C:
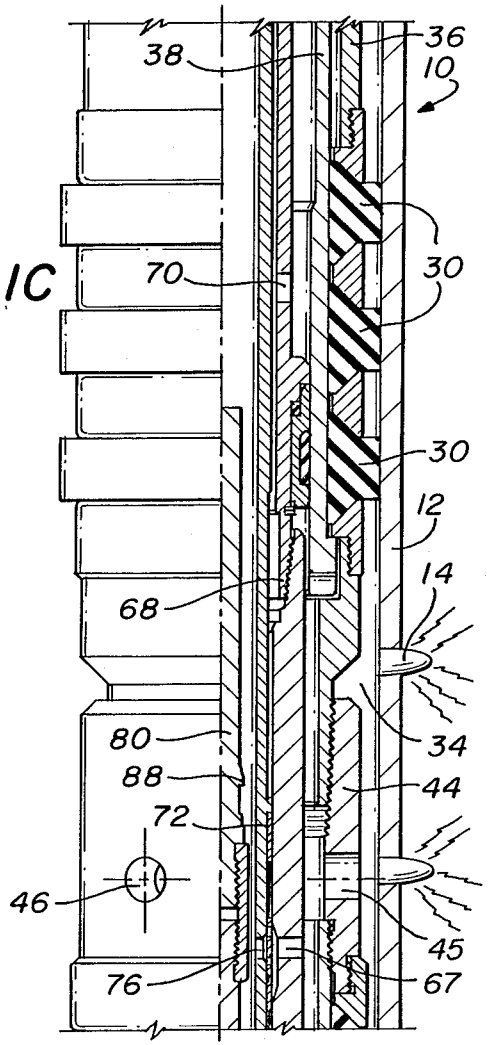
FIG. 1A through 1E comprise a vertical view of treating apparatus constructed in accordance with the invention shown partly in cross-section and partly in elevation disposed in the well bore.
Figure 1B:
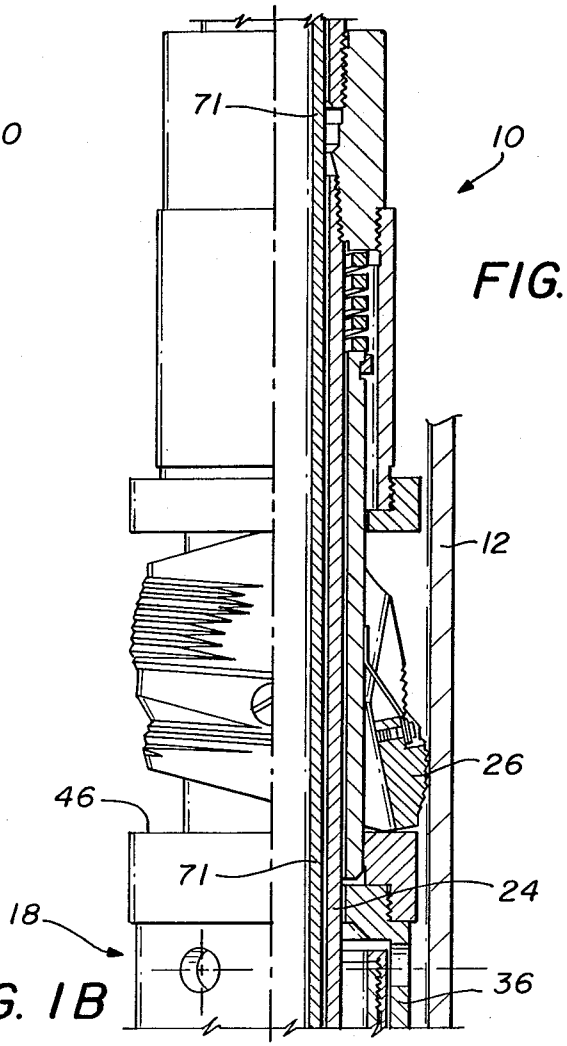
Figure 1A:
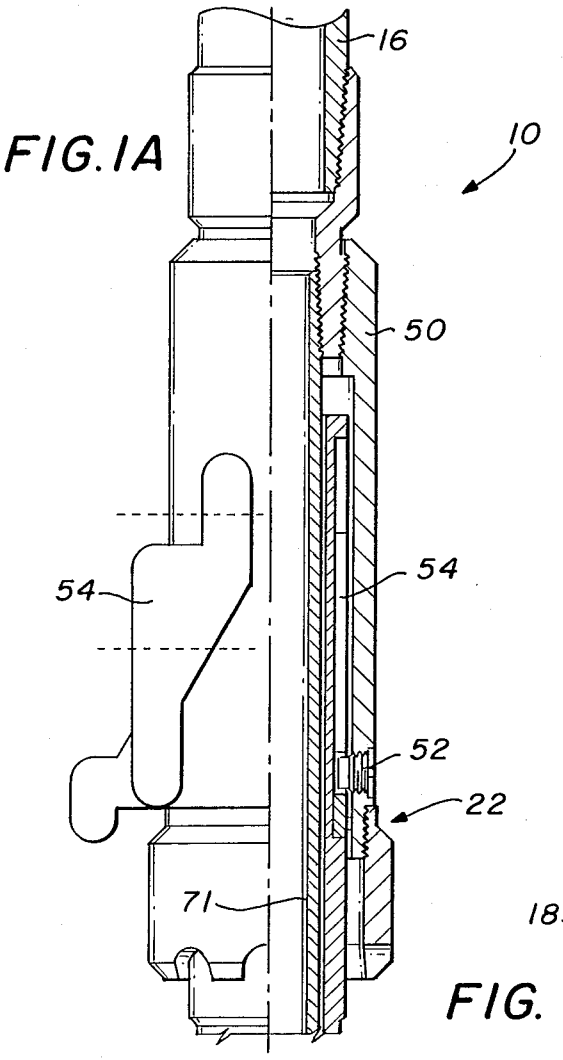

Referring to the drawing and to FIGS. 1A–1E in particular, shown therein and generally designated by the reference character 10 is apparatus for treating well bores that is constructed in accordance with the invention. The apparatus 10 is positioned in a casing 12 having perforations 14 therein on a tubing string 16. The tubing string 16 is threadedly attached to the upper end of the apparatus 10.

In broad terms, the apparatus 10 may be considered to include packer means generally designated by the reference character 18, valve means located within the packer means 18 and generally designated by the reference character 20, and operating means generally designated by the reference character 22 that is provided for setting and releasing the packer means 18 and for moving the valve means 20 among its various operating positions as will be described The packer means 18 includes a tubular mandrel 24 that extends axially through the packer means 18. At its upper end, the packer means 18 is provided with an upper gripping slip 26 that encircles the mandrel 24 and that is arranged to be pivoted between set and unset positions. As illustrated, the slip 26 is set with the teeth thereon in gripping engagement with the casing 12. The packer means 18 is also provided with a lower gripping slip 28 which is also pivotal between set and unset positions and is also illustrated in the set position.

The packer means 18 is also includes a plurality of upper deformable packing elements or members 30 which are illustrated as being deformed into sealing engagement with the casing 12. A plurality of lower deformable packing elements 32 are spaced from the upper elements 30 and are also illustrated in the deformed position. As illustrated, the packing elements 30 and 32 are located on opposite sides of perforations 14 and define an isolated zone 34 within the casing 12.

The packer means 18 is provided with telescoping sleeves 36 and 38 which function when telescoped to deform the upper elements 30. A second set of telescoping sleeves 40 and 42 provide the same function with respect to the lower packing elements 32. It will be noted that the packing elements 30 and 32 are held in fixed spaced relationship by a spacer assembly 44 having ports 45 extending therethrough and into the isolated zone 34.

The telescoping sleeve 36 has an upwardly facing shoulder 46 thereon which engages the upper slip 26 to pivot the upper slip 26 into the set position illustrated. Similarly, telescoping sleeve 40 has a downwardly facing shoulder 48 thereon that engages the lower slip 28 to pivot the lower slip 28 into holding engagement with the casing 12 during the setting of the packer means 18.

To effect the setting of the packer means 18, a portion of the operating means 22 is utilized. The operating means 22 includes an upper gudgeon carrier 50 that has a gudgeon pin 52 located therein. The gudgeon pin 52 extends into a j-slot 54 that is located in the upper end of the mandrel 24. The configuration of the j-slot 54 may be clearly seen in FIG. 6 where the j-slot 54 is shown in a layout. The gudgeon pin 52 is in the position indicated by the reference character 52A in FIG. 6 during the setting of the packer means 18.

The operating means 22 also includes a lower drag block assembly 56 that is comprised of a plurality of spring loaded frictional drag members 58. The members 58 are biased outwardly so that they engage the interior of the casing 12 to provide a frictional resistance against movement of the drag block assembly 56 through the casing 12 either vertically or in rotation. An upwardly facing shoulder 59 on the assembly 56 is provided for releasing the lower slips 28. The drag block assembly 56 also includes a lower gudgeon carrier 60 that has a gudgeon pin 62 mounted therein. The pin 62 extends into a lower j-slot 64 that is formed in the lower end of the mandrel 24.

A clutch 66 forms part of the assembly 56 and includes a compression spring 68 which constantly biases a plurality of clutch jaws 70 located on the gudgeon pin carrier 60 into or toward engagement with a plurality of clutch jaws 72 located on the lower end of the drag block 56.

Figure 2:
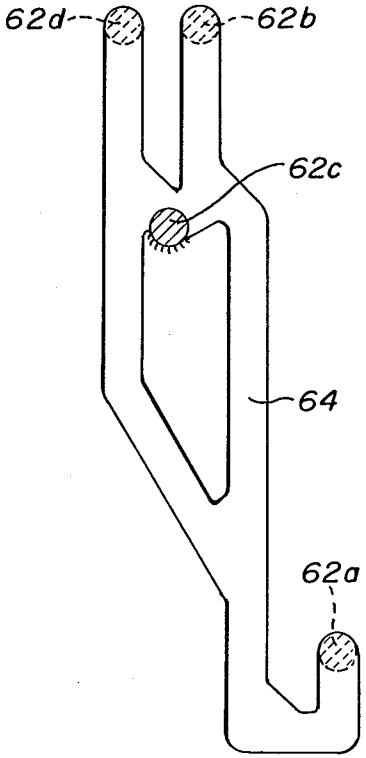
FIG. 2 is an enlarged layout illustrating one j-slot used in the apparatus for controlling the setting and releasing of the packer.
Figure 1E:
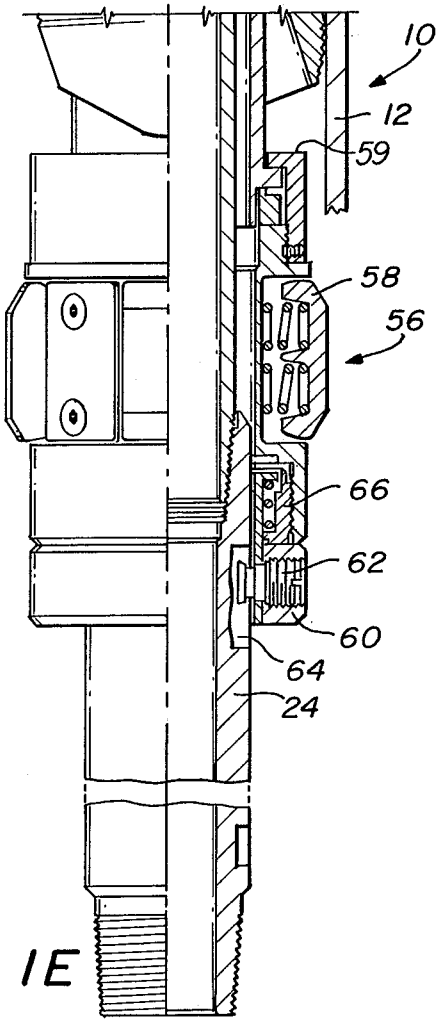
Figure 1D:
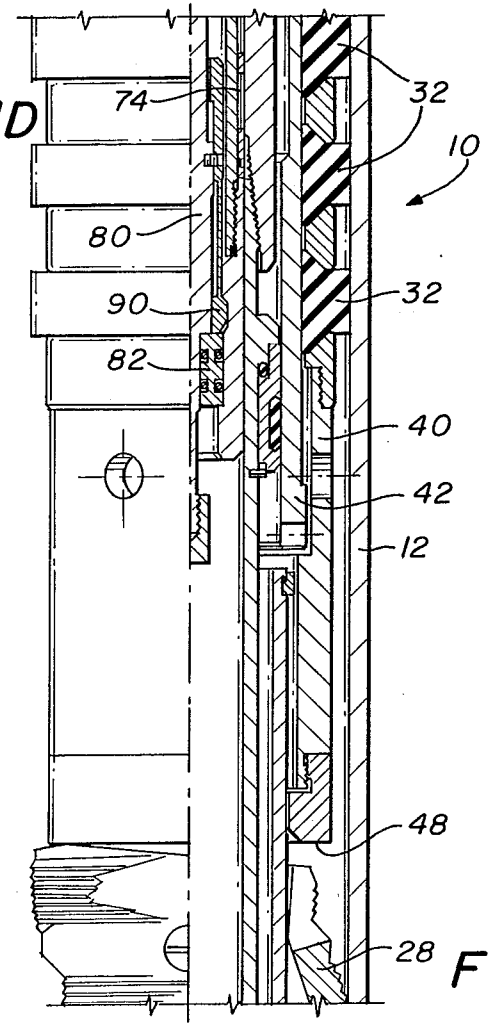
Figure 3:
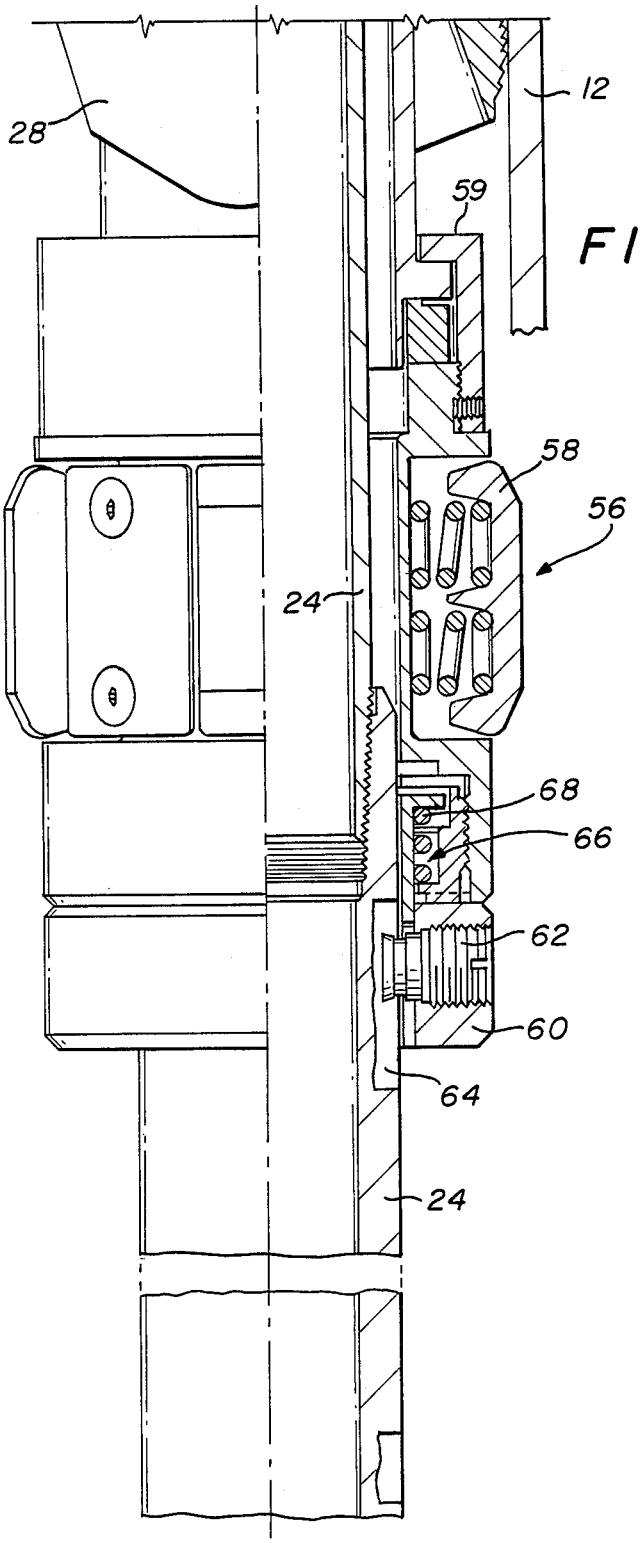
FIG. 3 is an enlarged view of a portion of the apparatus of FIG. 1 illustrating a clutch that is used therein.
Figure 4:
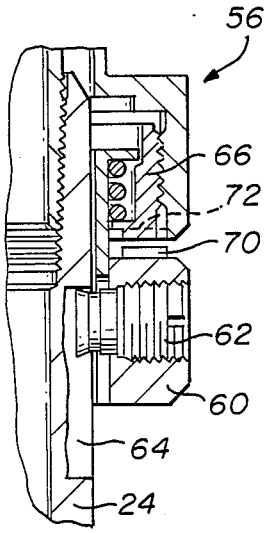
FIG. 4 is an enlarged, fragmentary view of a portion of the clutch of FIG. 3 showing the clutch in a different operating position.

The layout of the j-slot 64 is clearly shown in FIG. 2. In the transport or running-in-position, the gudgeon pin 62 is in the position indicated by the reference character 62A. When the packer means 18 is fully set, the location of the gudgeon pin 62 is indicated by the reference character 62C.

In addition to the j-slots 54 and 64, the mandrel also includes a treating port 67 that extends therethrough adjacent to the port 45 in the spacer 44. A recess 68 in the interior of the mandrel located above the port 67 is functional during circulation of fluid through the tool as will be later described. A circulation port 70 is also formed in the mandrel that is located above the recess 68 and the function of the port 70 will be described.

OPERATION OF THE PACKER MEANS 18

With the packer means 18 relaxed that is, in a transport or running position, the slips 26 and 20 are rotated so that they are not in engagement with the casing 12. The telescoping members 36, 38, 40 and 42 are spread relative to each other so that the packing elements 30 and 32 are relaxed and not in engagement with the casing 12.

Figure 6:
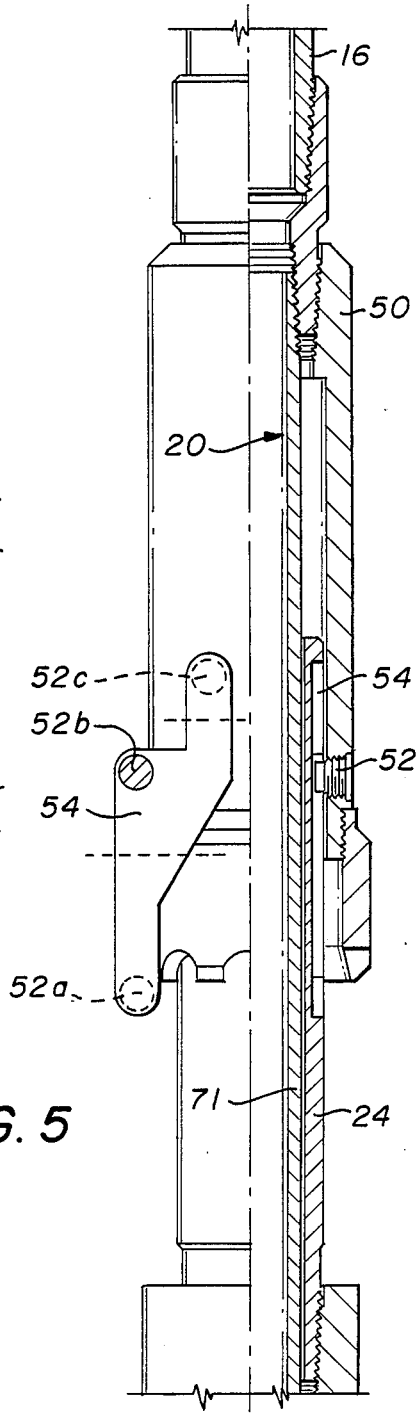
FIG. 6 is an enlarged, fragmentary view of the upper portion of the apparatus illustrating the mechanism utilized for operating the valve and showing superimposed thereon a layout of another j-slot used in the apparatus.

The gudgeon pin 52 is in the j-slot 54 near the lower end thereof as illustrated by the dash line 52A in FIG. 6. Also, the gudgeon pin 62 is located in the j-slot 64 at a position illustrated by the dash line 62A in FIG. 2. As thus arranged, the gudgeon pin 52 is transmitting force from the tubing 16 into the mandrel 24 and from the mandrel 24 and the j-slot 64 into the drag block assembly 56 pulling downwardly on the various components of the packer means 18 extending them so that the packing elements 30 and 32 are not deformed.

Upon reaching the desired location in the well bore that is, in a position adjacent to the perforations 14, downward movement of the tubing 16 is arrested. An upward strain is taken on the tubing 16, moving the gudgeon pin 52 to the position illustrated at 52B in FIG. 6 so that an upward force is exerted on the mandrel 24 thereby. The upward force moves the lower j-slot 64 upwardly relative to the gudgeon pin 62. As the lower end of the j-slot 64 engages the gudgeon pin 62, the clutch jaws 70 and 72 are brought into engagement by the clutch spring 68. The mandrel 24 can then be rotated relative to the drag assembly 6 and the lower end of the j-slot 64 moves relative to the pin 62 until the elongated portion of the j-slot 64 is aligned with the pin 62. The tubing 16 is then lowered causing the j-slot 64 to move downwardly with the pin 62 traveling relatively upwardly in the j-slot 64 until it reaches the position indicated by the dash line 62B.

As the mandrel 24 moves downwardly relative to the gudgeon pin 62, the shoulder 48 engages the lower slip 28 causing it to rotate into the set position, and the telescoping members 36, 38, 40 and 42 telescope relative to each other deforming the packing elements 30 and 32 into sealing engagement with the casing 12. As the deformation occurs, the upper slips 26 are rotated by the shoulder 46 into holding engagement with the casing 12.

If further deformation of the packing elements 30 and 32 and tightening of the engagement between the slips 26 and 28 and the casing 12 is desired, the tubing 16 is raised moving the mandrel 24 and j-slot 64 upwardly placing the gudgeon pin 62 in the position designated as 62C in FIG. 2. With the pin 62 in this position, farther upward movement of the tubing 16 applies the additional tightening force.

When it is desired to release the packing means 18, the tubing string 16 is lowered moving the mandrel 24 downwardly so that the gudgeon pin 62 is the position indicated as 62D. The string 16 is then raised with the slot 64 moving upwardly relative to the pin 62. A release lug (not shown) inside the upper slips 26 rotates the upper slips 26 to the released position. Further upward movement of the string 16 releases the compression load on the packing elements 30 and 32. Ultimately, the upward movement brings shoulder 59 on the drag block assembly 56 into engagement with the lower slips 28, rotating the slips 28 into the unset position. As will be appreciated, the packer means 18 is fully released and may be moved to another position in the well or removed therefrom.

DESCRIPTION OF THE VALVE MEANS 20

As illustrated in FIGURES 1A–1E, the valve means 20 is comprised of a hollow tubular valve member 71 secured at its upper end to the lower end of the tubing string 16 and to the upper gudgeon pin carrier 50. Near its lower end, the tubular valve member 71 carries a pair of annular seals 72 and 74 which are located on each side of treating ports 76 that extends through the wall of the tubular valve member 71. The seals 72 and 74 are located on the exterior of the tubular valve member 71 in sliding and sealing engagement with the interior of the mandrel 24. The valve member 71 is moveable from a circulating position to an open position and to a closed position as will be described hereinafter.

A plug 80 is located in the interior of the valve member 71 and carries a seal member 82 at the lower end thereof which forms a seal between the plug 80 and the interior of the valve member 71. Also, there is a releaseable locking mechanism generally designated by the reference character 84 that releaseably attaches the plug 80 to the valve member 71. A collet-type latching mechanism 84 is prevented from moving to the unlatched position by a shear pin 86 until the plug 80 is to be removed intentionally from the valve member 71.

Near the upper end of the plug 80 there is provided an annular shoulder 88 that can be engaged by a retrieving mechanism (not shown) when it is desired to remove the plug 80. An upward pull thereon shears the pin 86 moving the plug 80 upwardly relative to the latching mechanism 84 until such time as collet fingers 90 drop off the shoulder 92. The plug 90 is then released from the tubular valve member 71. The plug 80 can then be retrieved and the entire interior of the tubular valve member is open providing full opening through the treating apparatus 10.

OPERATION OF THE VALVE MEANS 20

As previously mentioned, the valve means 20 is moveable among open, closed, and circulate positions.

As illustrated in FIG. 1, the valve means 20 is located in the open or treating position. This is also the position that the valve means 20 occupies as the treating apparatus 10 is run into the well bore. When in the open position, the gudgeon pin 52 has been moved downwardly relative to the j-slot 54 until it occupies the position indicated at 52*a* in FIGS. 6 and 8. Thus, the valve member 71 has been displaced downwardly relative to the mandrel 24 so that the treating ports 76 in the valve member 71 are in alignment with the ports 67 which extends through the mandrel 24. In this position of the valve member 71, the seals 72 and 74 are disposed on each side of the aligned ports 67 and 76. As the apparatus 10 is moved downwardly into the well bore, well bore fluids can enter the interior of the valve member 71 through the ports 45 in the spacer assembly 44 and through the aligned ports 67 and 76.

Figure 5:
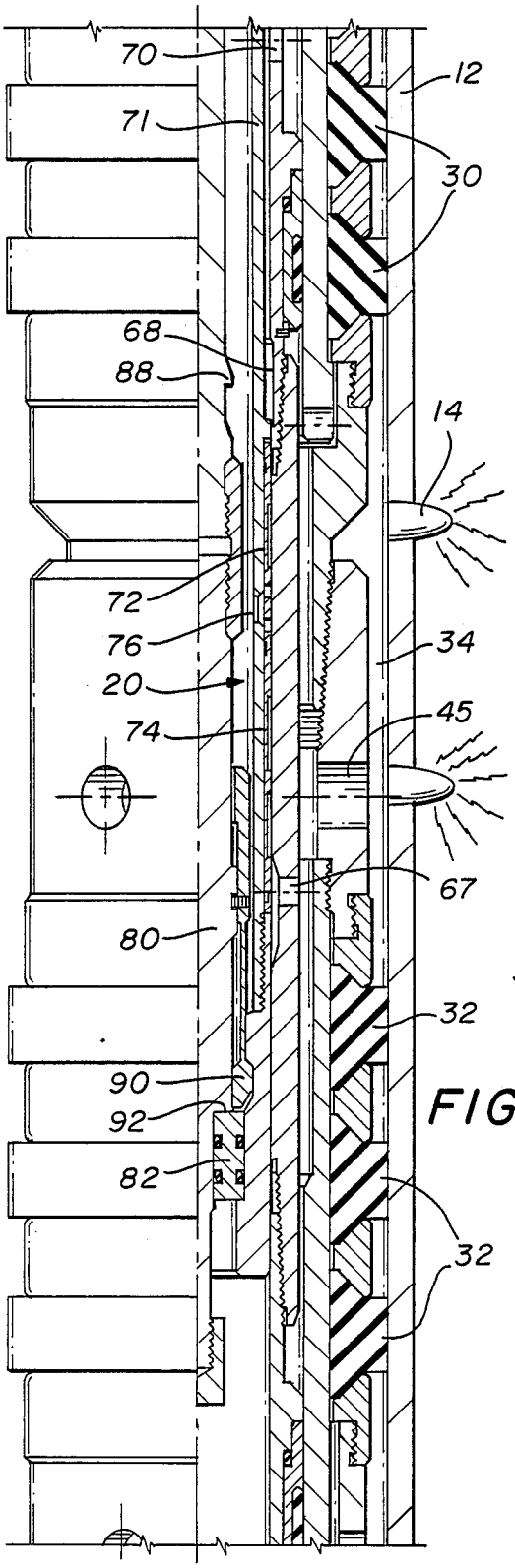
FIG. 5 is an enlarged, fragmentary cross-sectional view showing a valve in the treating apparatus that is located in a different operating position from that shown in FIG. 1.

Upon reaching the desired location in the well bore and as the packer means 18 is set, tension taken on the tubing string 16 and the upward movement thereof moves the pin 52 upwardly relative to the j-slot 54 repositioning the pin 52 at the position indicated at 52*b* in FIG. 6. In this position, the valve member 71 has been moved upwardly relative to the mandrel 24 moving the treating ports 76 out of alignment with the ports 67 in the mandrel. It will be noted in FIG. 5 that the seals 72 and 74 carried by the valve member 71 isolate the ports 76 from the ports 67, shutting off the ports 67 and thus no fluid flow can occur either into or out of the valve member 71.

When it is desired to circulate fluid through the valve member 71, such as when preparing for inserting treating material into the isolated zone 34, material can be circulated downwardly through the tubing string 16 displacing the well fluids therein to clean the treating apparatus 10 prior to performing the treating of the isolated zone 34.

Figure 7:
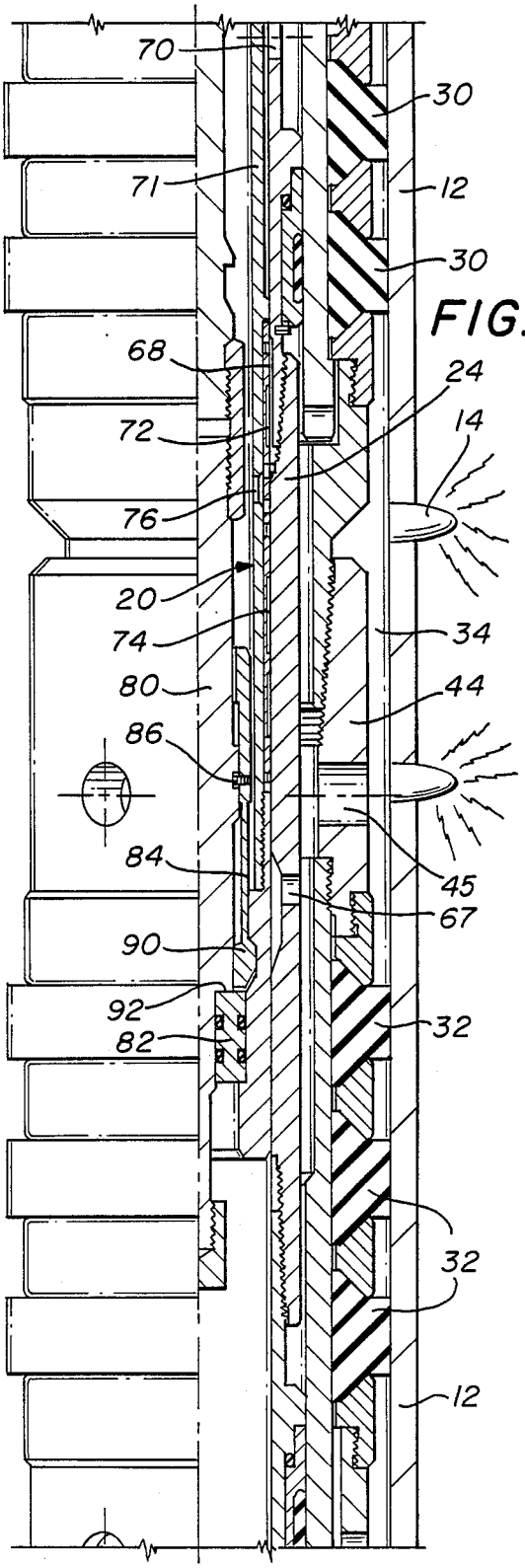
FIG. 7 is a view similar to FIG. 5 showing the valve in still another operating position.
Figure 8:
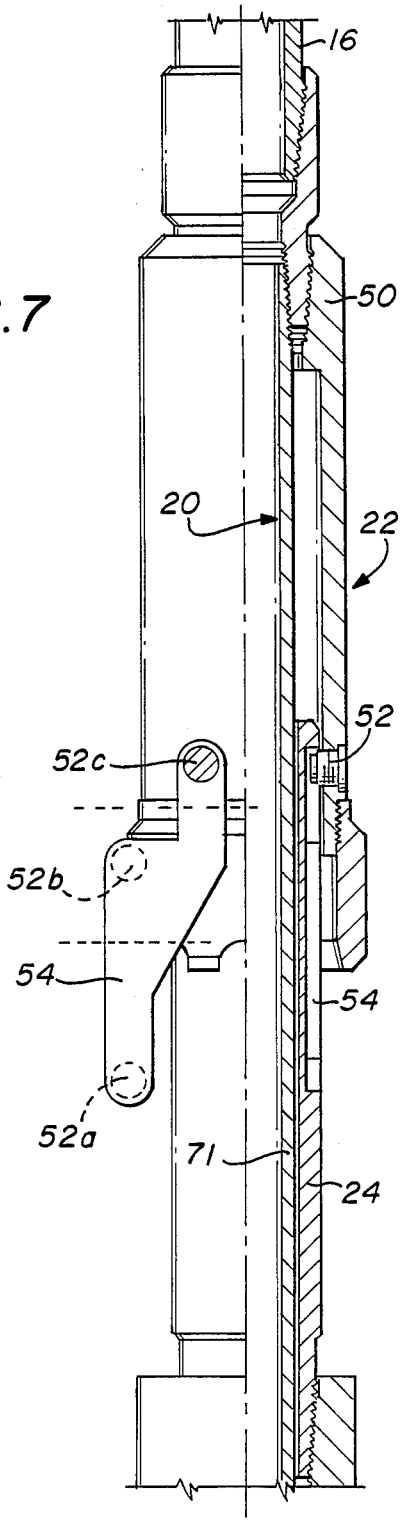
FIG. 8 is a view similar to FIG. 6, but illustrating the apparatus in still another operating position.

To position the valve means 20 properly for circulation, the tubing string 16 is rotated and raised moving the gudgeon pin 52 into the position illustrated at 52*c* and shown in solid lines in FIG. 8. When the valve member 71 has been raised the additional amount necessary to move to this position, it will be noted in FIG. 7 that the upper seal 72 carried on the valve member 71 is adjacent to a recess 68 formed in the mandrel 24. Accordingly, the interior of the valve member 71 is in communication with the annular space between the valve member 71 and the interior of the mandrel 24 through the treating port 76. While no treating fluids can be injected into the isolated zone 34, the well fluids can be displaced downwardly through the tubing 16 and outwardly through the treating port 76 so that they are discharged into the annular space between the treating apparatus 10 and the casing 12 above the packing elements 30.

When the desired amount of circulation has occured, the tubing string 16 can again be lowered so that the gudgeon pin 52 moves downwardly in the j-slot 54 to the open position indicated at 52*a* on FIGS. 6 and 10. The downward movement of the tubing string 16 again returns the valve member 71 downwardly to the open position previously described in connection with the description of FIG. 1.

The desired treating operations can then be performed on the isolated zone 34 and through the perforations 14 in the casing as desired. The valve means 20 can be manipulated through the various positions as desired and when desired so that various treating operations can be performed and the isolated zone 34 shut in or opened to further treatment as desired.

It should also be pointed out that one advantage of the treating apparatus 10 is that, with the retrievable packer means 18, the apparatus 10 can be set in the well before reaching the perforations 14 and manipulations of the valve means 20 effected to provide for the complete pressure testing of the apparatus 10 prior to its being placed adjacent to the desired treating area. Also, it will be appreciated that the versatility of the apparatus 10 permits its movement to any desired number of zones in a well bore. Having described one embodiment of the invention, it will be understood that any changes or modifications can be made thereto without departing from the spirit or scope of the invention.

What is claimed is:

1. Apparatus for treating well bores arranged to be positioned in the well bores on tubing and the like, said apparatus comprising:

packer means having an elongated, hollow, mandrel extending axially therethrough, first and second spaced, deformable packer elements encircling said mandrel for isolating a portion of the well bore, gripping slips for locking said packer means in said wellbore, said mandrel having first ports therein providing communication between the interior of said mandrel and the well bore above the packer elements, and second ports located therein between said packer elements and providing communication between the interior of said mandrel and the well bore;

hollow, elongated valve means including a valve seal member slidingly disposed within said mandrel for movement between a first open position permitting fluid flow through said second ports to said isolated portion, a second closed position preventing fluid flow through said second ports to said isolated portion and a third circulate position permitting circulation of fluid through said first ports, said valve seal member being movably located within said mandrel and movable therein among said open, closed, and circulate positions and having spaced annular seal members thereon in sliding and sealing engagement with said mandrel and having a port therein between said seal members for communicating with said second ports in said mandrel when said valve means is in the open position; and, operating means for setting said gripping slips and deforming said packer elements, operating means for moving said valve means, and operating means for releasing said gripping slips and said packer elements.

2. The apparatus of claim 1 wherein:

said operating means includes a gudgeon pin carrier arranged for connected to the tubing and overlying a portion of said mandrel;

said valve means includes an elongated valve seal member having one end connected to said gudgeon pin carrier; and said mandrel has a j-slot therein slidingly receiving said gudgeon pin whereby said valve seal member can be moved through said positions by said gudgeon pin carrier.

3. The apparatus of claim 2 wherein:

said mandrel has a second j-slot formed therein;

said operating means also includes friction means for frictionally engaging the wall of the well bore, said friction means encircling said mandrel and carrying a second gudgeon pin located in said second j-slot; and said mandrel being moveable relative to said friction means among running, setting and releasing positions for running said apparatus into the well bore and for setting and releasing said gripping slips and for deforming and releasing said packer elements.

4. The apparatus of claim 2 wherein said valve seal member is tubular and said apparatus also includes:

a plug member located within and closing said valve seal member; and latch means releaseably selectively securing said plug member in said valve seal member for preventing flow therethrough and releasing said plug member permitting flow therethrough.

5. The apparatus of claim 3 wherein said valve seal member is tubular and said apparatus also includes:

a plug member located within and closing said valve seal member; and latch means releaseably selectively securing said plug member in said valve seal member for preventing flow therethrough and releasing said plug member permitting flow therethrough.

* * * * *